US005842258A

United States Patent [19]

Harvey et al.

[11] Patent Number: 5,842,258

[45] Date of Patent: Dec. 1, 1998

[54] MANUFACTURE OF INK JET PRINTHEADS

[75] Inventors: Robert Alan Harvey; Stephen Temple, both of Cambridge, England

[73] Assignee: Xaar Technology Limited, Cambridge, England

[21] Appl. No.: 708,146

[22] Filed: Sep. 3, 1996

Related U.S. Application Data

[63] Continuation of PCT/GB95/0001 Jan. 3, 1995.

[30] Foreign Application Priority Data

Jan. 4, 1994 [GB] United Kingdom ..... 9400036

[51] Int. Cl.[6] ..... H04K 17/00

[52] U.S. Cl. ..... 29/25.23; 29/890.1; 156/257

[58] Field of Search ..... 29/25, 35, 890.1; 156/250, 257; 347/68, 71

[56] References Cited

U.S. PATENT DOCUMENTS

| | | | |
|---|---|---|---|
| 4,789,425 | 12/1988 | Drake et al. | 156/644 |
| 5,010,356 | 4/1991 | Albinson | 346/140 |
| 5,016,028 | 5/1991 | Temple | 346/140 |
| 5,041,190 | 8/1991 | Drake et al. | 347/65 X |
| 5,160,403 | 11/1992 | Fisher et al. | 156/633 |
| 5,185,055 | 2/1993 | Temple et al. | 156/630 |
| 5,189,437 | 2/1993 | Michaelis et al. | 346/1.1 |

FOREIGN PATENT DOCUMENTS

| | | |
|---|---|---|
| 214 733 | 3/1987 | European Pat. Off. . |
| 522 814 | 1/1993 | European Pat. Off. . |
| WO 91/17051 | 11/1991 | WIPO . |
| WO 93/15911 | 8/1993 | WIPO . |
| WO 95/04658 | 2/1995 | WIPO . |
| WO 95/11131 | 4/1995 | WIPO . |

*Primary Examiner*—Linda Johnson
*Attorney, Agent, or Firm*—Marshall, O'Toole, Gerstein, Murray & Borun

[57] ABSTRACT

Ink jet printhead components are formed initially by bonding together a grooved base wafer and a suitable cover wafer, the area of the bonding wafer assembly being sufficient to provide a 14×14 array of components. Using a datum formation, the wafer assembly is divided into strips and linear processing steps are conducted, such as applying nozzle plates and laser ablating nozzles. Each strip can then be divided to form separate printhead components.

60 Claims, 8 Drawing Sheets

MANUFACTURE OF INK JET PRINTHEADS

This application is a continuation of co-pending International Application No. PCT/GB95/00001 filed Jan. 3, 1995.

In an important example, the invention finds particular application with printheads of the type in which grooves are formed in poled piezo-electric ceramic to which a cover plate is applied affording ink channels between piezo-electric wall actuators.

Techniques have been developed for the manufacture of such printheads to the fine scale and strict tolerances necessary for a properly functioning printer. Reference will be directed to a number of relevant disclosures in the more detailed description which follows. Existing techniques, however, do not admit easily—if at all—of high volume production.

Serial printhead components (that is to say components for printheads that are to be scanned across the printed page) are small, typically of the order of 5 to 10 mm and include features of dimension 50 to 100 $\mu$m. Accordingly, extremely accurate positioning is required during the various process steps. The use of individual assembly jigs, which is generally satisfactory for small scale production in which skilled engineers are required to perform individual fine adjustments and to maintain quality control, is simply not practicable for manufacture at high yield at the rate of thousands or more per day.

For certain ink jet technologies, using photoresist etching of silicon and similar techniques, it has been proposed by analogy with integrated circuit manufacture, to conduct processing on a silicon wafer which is subsequently diced to produce individual printhead components.

Thus EP-A-0214733 describes a drop-on-demand ink jet printhead produced from components deposited and etched on silicon at wafer-scale. During assembly, the printhead is constructed from two identical parts, which are diced prior to face to face assembly. The nozzles are thereby formed at the ends of etched grooves in each part. U.S. Pat. No. 4789425 shows a drop-on-demand ink jet printhead constructed on a wafer scale resulting in a so-called "roof-shooter" construction of printhead. The cover is a laminated photoresist layer in which the nozzles are formed photolithographically. The wafer is then diced to produce individual printheads.

These proposals are highly specific and are generally not of assistance with printheads of the construction with which this invention in the most important example, is concerned. Moreover, there remain after dicing of the wafer into printhead components, a number of key process steps which still demand accurate positioning. There is still, therefore, heavy reliance placed upon jigging.

It is an objective of the present invention to provide an improved method of manufacturing ink jet printheads, particularly—but not exclusively—related to constructions having grooves in poled piezo-electric ceramic to which a cover plate is applied. The invention is particularly suited to end shooter printhead constructions and to printheads actuated by piezo-electric shear mode wall actuators.

Accordingly, the present invention consists in one aspect in a method of making pulsed droplet deposition heads each having a predetermined number of droplet liquid channels comprising the steps of surface area processing on a wafer scale to form a rectangular array of bonded head components, sectioning said rectangular array to form strips each comprising two or more bonded head components each having the predetermined number of droplet liquid channels in a linear array; and linear processing of a plurality of said linear arrays including forming a nozzle for each channel.

Preferably, the step of surface processing comprises the steps of locating a base wafer; forming grooves in the base wafer and bonding a cover wafer to the base wafer so as to close a portion at least of each groove, thereby to form droplet deposition channels.

Suitably, the step of locating a base wafer utilises edge registration.

Advantageously, the step of surface area processing further comprises the step of forming, with the same location of the base wafer as used in the forming of said grooves, a datum formation defining a datum line, wherein the step of sectioning said rectangular array comprises forming strips perpendicular to the datum line with each strip containing a segment of said data formation and wherein the step of linear processing includes the step of registering with said datum formation segment to assure alignment with said droplet deposition channels.

In one form of the invention, said datum formation comprises a cut edge parallel to said grooves.

In a further aspect, the present invention consists in a method of making ink jet printhead components, each having N parallel ink. channels of length L terminating in respective nozzles, comprising the steps of providing a base wafer; processing the base wafer to define n×N parallel groove formations of a length in excess of m×L, where m and n are integers greater than one; providing a cover over said base wafer in an integral wafer assembly, with the cover serving to close portions of said groove formations to form channels; sectioning said wafer assembly along parallel first section lines perpendicular to said groove formations to form m strips each sectionable along second section lines parallel to said groove formations to form n printhead components; and applying to each of the said strips, at the location of a first section line, a nozzle plate to define said nozzles.

Advantageously, the step of processing the base wafer to define groove formations includes the definition of a datum formation parallel to said groove formations and positioned such that each of the strips resulting from the sectioning of the wafer assembly along said first section line contains a segment of the datum formation providing registration with the channels of that strip.

A preferred embodiment of this further aspect of the present invention provides (A) surface area processing on a wafer scale including the steps of:

(i) planarising the surface area of a rectangular base wafer of piezo-electric material poled in the thickness direction;

(ii) providing a rectangular m×n array of base components separated by dimensionally determined horizontal and vertical wafer dividing lines and forming each component with a number of closely spaced parallel grooves corresponding to the number and spacing of said channels in the surface area of said wafer in m locations aligned in the vertical direction in n strips separated by said vertical dividing lines, the length of the grooves from said horizontal dividing lines in the locations in each strip corresponding with the length of said channels thereby to afford walls of said material between said channels;

(iii) applying electrodes in relation to said walls by depositing electrode metal over the surface area of said wafer and removing metal from the tops of the walls between said grooves, so that an electric field can be applied to effect shear mode displacement transversely of said walls adjacent selected said channels;

(iv) planarising the surface area of a rectangular cover wafer of material thermally matched to said material and forming a rectangular m×n array of cover components separated by horizontal and vertical cover dividing lines each cover component having a window cut therein providing a droplet liquid supply manifold to said channels and a corresponding location in regions of each cover component between the window and said horizontal cover dividing lines in n strips in alignment with mn corresponding windows in the vertical direction in the surface area of said cover wafer;

(v) bonding the mating surface areas of said base wafer and said cover wafer by applying adhesive and pressure to bring the surface extremities of said respective surfaces substantially into direct contact and holding the respective locations in each said wafer in alignment thereby to form a rectangular array of m×n bonded printhead components;

(B) sectioning the rectangular array of bonded components along the said horizontal dividing lines to form a section plane having open channel ends normal to said grooves thereby forming m strips each comprising a linear array of n bonded printhead components;

(C) linear processing of one or more linear arrays of bonded printhead components butted end to end in sequence in steps including the steps of:

(i) bonding a nozzle plate to seal the open ends of said grooves, the plate extending at least the number of channels corresponding to one printhead component; and (ii) forming nozzles connected with said grooves for liquid drop ejection at a spacing corresponding with the spacing of said channels; and (D) sectioning each linear array of bonded components along the said vertical dividing lines to form n separate bonded printhead components.

Preferably, the method of making pulsed droplet deposition apparatus according to this preferred embodiment comprises a step of aligning the base wafer and the cover wafer by edge registration of the wafers, so that after bonding the dimensionally determined horizontal and vertical wafers dividing lines coincide with the horizontal and vertical cover dividing lines bringing the m locations having a number of closely spaced parallel grooves in the wafer into register with the m locations in the cover having cover regions between the window and the horizontal cover dividing lines.

Advantageously, the method further comprises the step of aligning the base wafer and the cover wafer, by locating two edges of the rectangular base wafer relative to three locating pins for forming the grooves therein, locating two corresponding edges of the rectangular cover wafer relative to three locating pins for cutting the windows and the cover edges therein, and locating the base wafer and the cover wafer against each said two edges in relation to three locating pins for bonding.

In still a further aspect, the present invention consists in a method of making ink jet printhead components, each having N parallel ink channels of length L terminating in respective nozzles, comprising the steps of providing a base wafer; processing the base wafer to define n×N parallel groove formations of a length in excess of m×L, where n is an integer and m is an integer greater than 1, the section of each groove formation varying along the length thereof with alternating mirror reversed groove segments; providing a cover over said base wafer in an integral wafer assembly, with the cover serving to close portions of said groove formations to form channels separated by channel walls; sectioning said wafer assembly along parallel first section lines perpendicular to said groove formations to form m strips, the first section lines alternating odd and even with said groove segments; applying to each of the said strips, at the location of a first odd section line, a nozzle plate to define said nozzles; and, where n is greater than 1, sectioning each strip along second section lines parallel to said groove formations to form n printhead components.

Preferably, each groove segment has adjacent the even first section lines a region of reduced wall height, accommodating electrical terminations for the respective channels and/or serving for the supply of ink to the respective channels from a common source of ink.

Suitably, the region of reduced wall height is formed by reducing locally the depth of the groove formation.

Alternatively, the region of reduced wall height is formed by a trench extending perpendicularly of the groove formations.

In still yet a further aspect, the present invention consists in an ink jet printhead comprising a base including piezoelectric material and having parallel grooves formed therein to define ink channels separated by active walls; electrode means for the application of electric fields to selected ones of the active walls; a cover secured to the base in a manner as to close the ink channels over a working channel length; a nozzle plate defining a nozzle for each channel at corresponding respective ends of the channels; and ink supply means for the supply of ink to the channels; characterised in that a trench is formed in the base extending perpendicularly of and communicating with the channels, said trench defining an ink conduit within said ink supply means.

The invention will now be described by way of example by reference to the following diagrams, of which:

Figure 1:
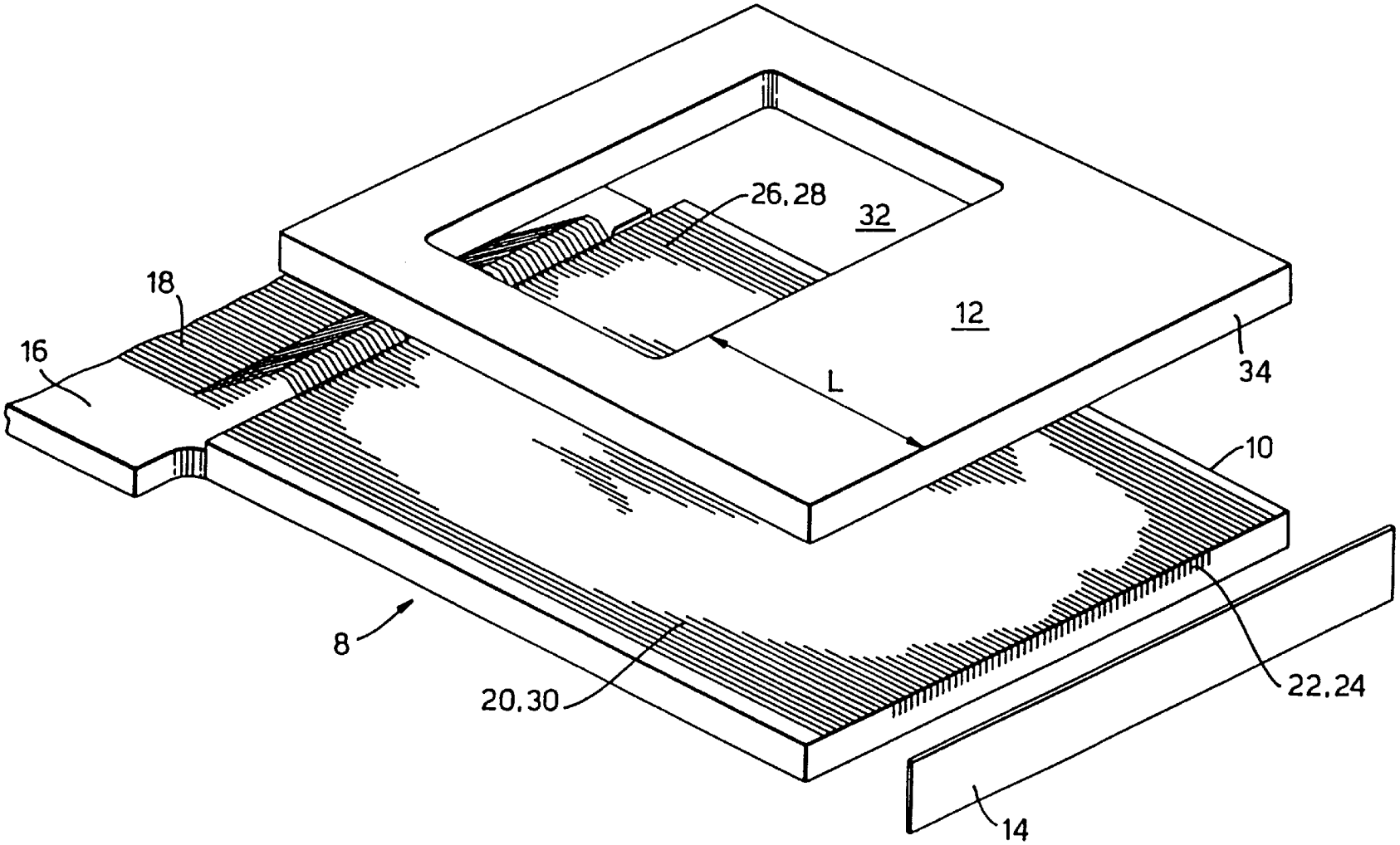
FIG. 1 shows an exploded view in perspective of the components comprising a single serial ink jet printhead, including a printhead base into which parallel grooves are formed, a circuit board with connection tracks, a cover component and a nozzle plate.

FIG. 1 shows an exploded view in perspective of an ink jet printhead 8 incorporating piezo-electric wall actuators operating in shear mode. It comprises a base component 10 of piezo-electric material poled in the thickness direction, a cover component 12 and a nozzle plate 14. A circuit board 16 is also illustrated which has connection tracks 18 for application of electrical signals for drop ejection from the printhead.

The base component 10 is formed with a multiplicity of parallel grooves 20 formed in the sheet of piezo-electric material, as described in U.S. Pat. No. 5016028 (EP-B-0364136). The base component has a forward part in which the grooves 20 are comparatively deep to provide ink channels 22 separated by opposing actuator walls 24. The grooves rearwardly of the forward part are comparatively shallow to provide locations 26 for connection tracks 28. After forming the grooves 20, metallised plating is deposited by vacuum deposition in the forward part at angles so chosen as to cause the plating to extend approximately one half of the channel height from the tops of the walls, so providing electrodes 30 on opposing faces of the ink channels 22. At the same time the electrode metal is deposited in the rearward part in the locations 26 providing connection tracks 28 connected to the electrodes 30 in each channel. The tops of the walls separating the grooves are kept free of plating, either by lapping or as in U.S. Pat. No. 5185055 (EP-B-0397441) by initially applying a polymer film to the base 10, and removing the metallised plating by causing removal of the film. After application of the metal electrodes 30 the base component 10 is coated with a passivant layer for electrical isolation of the electrodes from ink.

The cover component 12 illustrated in FIG. 1 is formed of a material thermally matched to the base component 10. One solution to this is to employ piezo-electric ceramic similar to that employed for the base so that when the cover is bonded to the base the stresses induced in the interfacial bond layer are minimised. The cover is-cut to a similar width to the base component but shorter, so that after bonding there remains a length of the tracks 28 in the rearward part uncovered for bonded wire connections to the connection tracks 18. A window 32 is formed in the cover which provides a supply manifold for the supply of liquid ink into the channels 22. The forward part of the cover from the window to the forward edge 34 is of length L as indicated in the diagram. This region when bonded to the tops of the walls 24 determines the active channel length, which governs the volume of the ejected ink drops.

Figure 2:
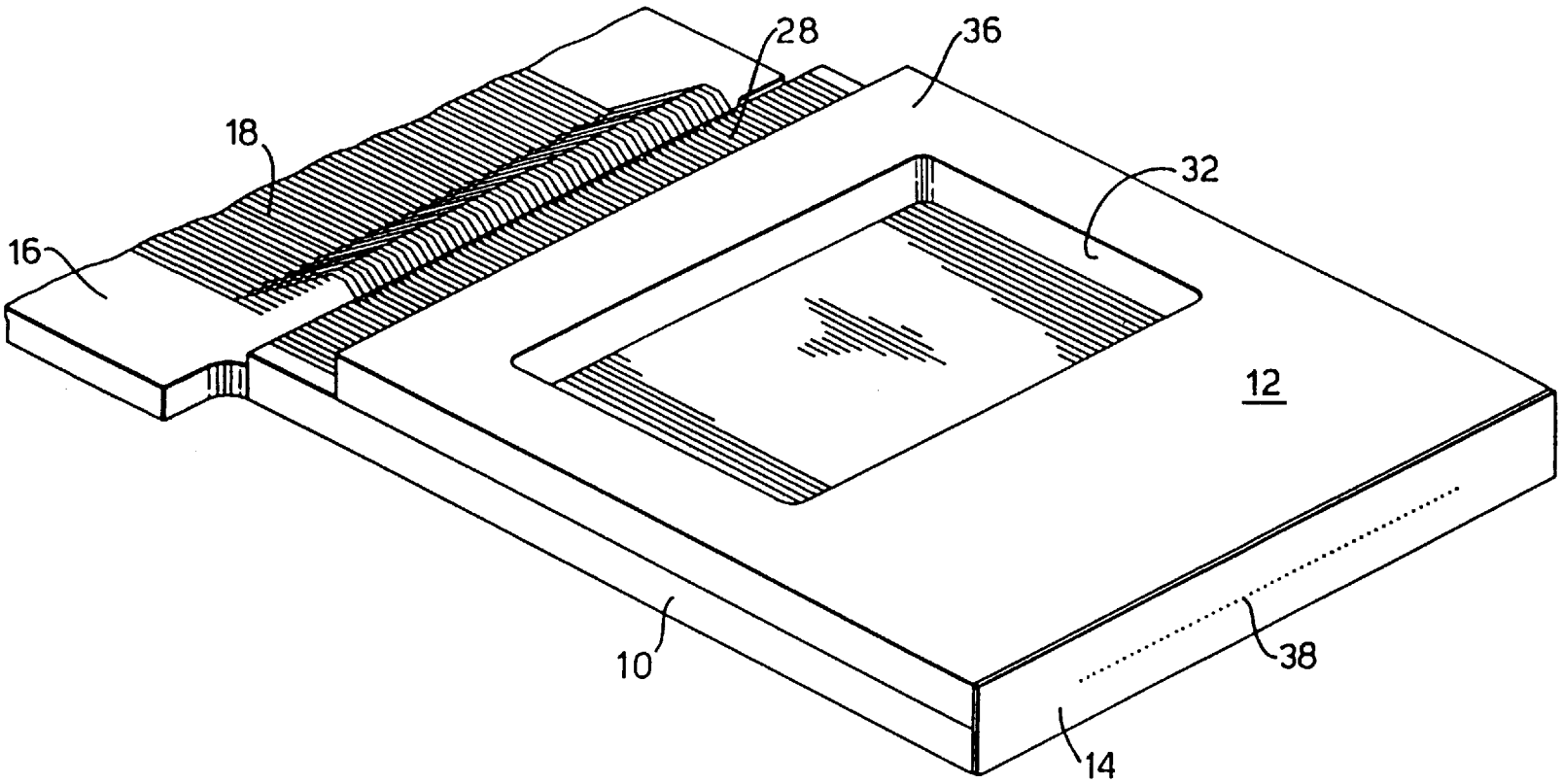
FIG. 2 illustrates the printhead of FIG. 1 after bonded assembly of the cover, the nozzle plate and the circuit board components to the printhead base, thereby forming a bonded printhead component.

The base component and cover component are illustrated after bonding in FIG. 2. The method of bonding is disclosed in co-pending international patent application PCT/GB94/01747. Particular care is taken by attention to the machining tolerances of the forward edge 34 of the cover component 12 and its alignment with the corresponding edge of the base component 10 and by the design of the assembly jig to ensure that the front faces of the bonded printhead component 36 are held co-planar for attachment of the nozzle plate 14.

The nozzle plate 14 consists of a strip of polymer such as polyimide, for example Ube Industries polyimide UPILEX R or S, coated with a non-wetting coating as provided in U.S. Pat. No. 5010356 (EP-B-0367438). The nozzle plate is bonded by application of a thin layer of glue, allowing the glue to form an adhesive bond in contact with the front face of the bonded component 36 thereby forming a bonded seal between the nozzle plate 14 and the walls surrounding each channel 22 and then allowing the glue to cure. After application of the nozzle plate, nozzles are formed in the nozzle plate connecting into each channel 22 at the nozzle spacing appropriate to the printhead, as disclosed in U.S. Pat. No. 5189437 (EP-B-0309146). The number of nozzles and ink channels in a serial printhead is typically 50–64. The nozzles 38 are indicated in FIG. 2.

After assembly of the bonded printhead component 36, the circuit board 16 is bonded to it to provide connection tracks 18, and bonded wire connections are made joining the tracks 18 to corresponding connection tracks 28 in the rearward part to the base component 10.

The printhead component 36, when supplied with ink and operated with suitable voltage signals via the tracks 18, is designed for use typically, when traversed either normally or at a suitable angle to the direction of motion across a paper printing surface, to print a single line of characters at a time of height about one sixth to one tenth of an inch.

Accordingly it will be realised that the components above are generally very small, typically the size of a finger nail, and that the details described are so small that they can only be inspected under a microscope. At the same time the component is designed for mass manufacture under clean conditions in quantities of thousands up to tens of thousands per day where it will be seen that it is difficult to handle single small precision components in such large quantities under clean conditions with a high manufacturing yield.

The piezo-electric ceramic material used in the construction of the printhead is available in wafers of the order of 10 cm in size. It has therefore been a desirable process objective to develop a method of wafer scale manufacture, whereby appropriate sub-components of the printhead are capable of manufacture and bonded assembly on a wafer scale. In accordance with this invention the wafers are then divided into linear arrays of printheads butted end to end and are subjected to linear processing in processes such as bonded attachment of the nozzle plates, nozzle forming, wire bonding, electrical performance testing, cleaning with flushing fluids, filling with ink, before being separated for use.

On such a scale the production is reduced to manageable proportions so that for example the production of 10,000 serial printheads in one day demands a total wafer area of up to 0.5 $m^2$ involving typically one hundred wafers during the wafer processing stages and a few tens of metres of linear length of printhead array during the linear processing steps a day.

It is recognised in the present invention that working with linear arrays of printhead components, divided from wafer-scale bonded assemblies, enables the handling and processing of individual printhead components to be kept to an absolute minimum.

Figure 3:
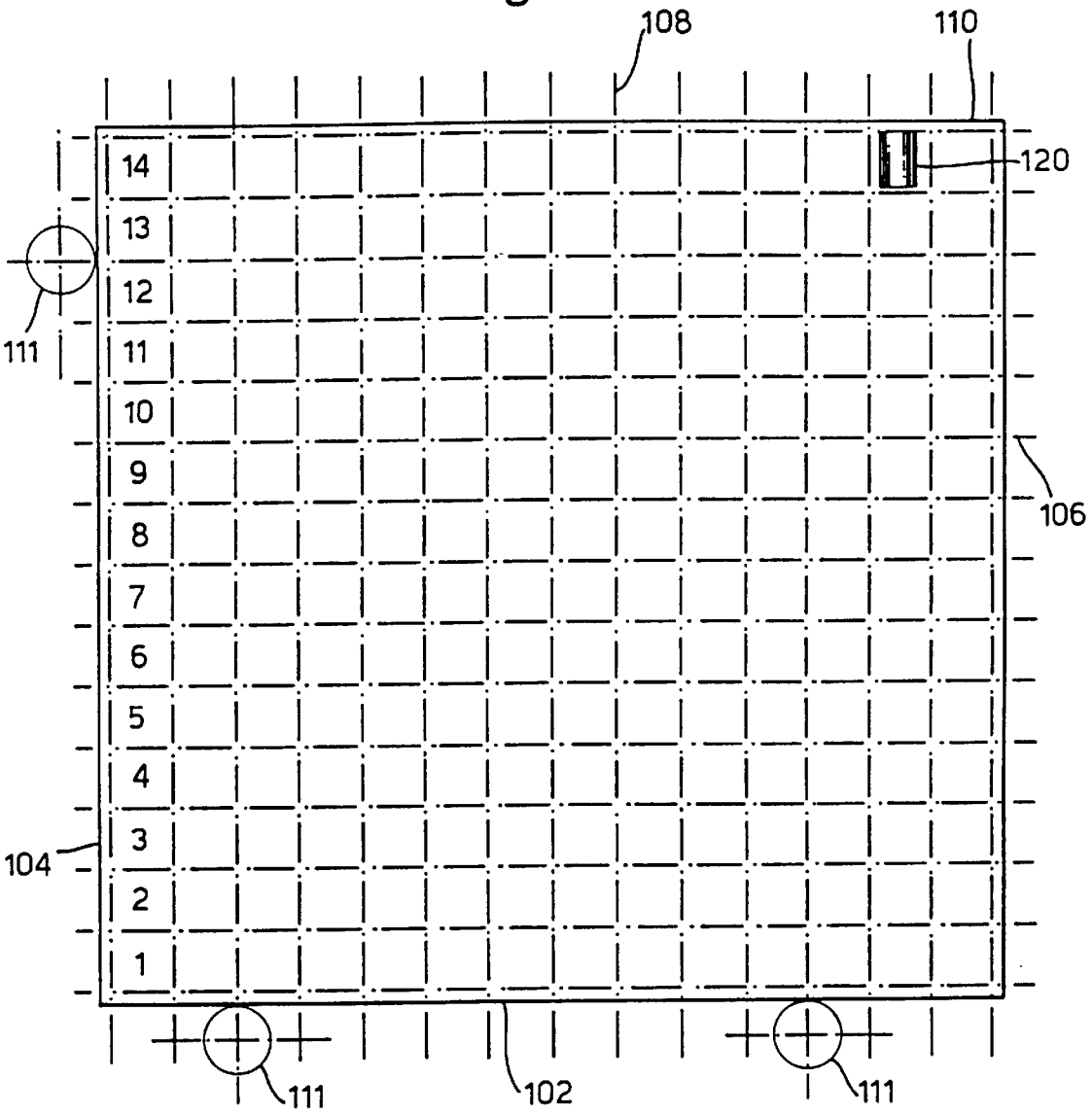
FIG. 3 shows a rectangular base wafer comprising a rectangular array of printhead base components into which parallel grooves are formed to provide ink channels in each component.

Returning to the drawings, a rectangular base wafer 110 of thickness poled piezo-electric ceramic carrying 14×14 base components 10 is illustrated in FIG. 3. The base wafer 110 has straight edges 102 and 104 used during wafer scale processing for alignment by locating the wafer in each processing step in contact with three dowel pins 111. One edge 102 is placed in contact with two pins in the process jig and the section edge 104 is pressed against the remaining pin. By this means the wafer is located in the jigs used for wafer scale processes such as forming grooves 120 to provide ink channels, bonding the base wafer 110 and the cover wafer 112 (shown in FIG. 4) in alignment, and sectioning the wafers after bonding to form linear arrays of bonded printhead components 136.

The base wafer is illustrated in FIG. 3 divided into regions defining a 14×14 rectangular array of base components 10 by an overlay of horizontal and vertical chain dotted lines 106 and 108. The horizontal chain dotted lines represent the dividing lines along which the rectangular bonded wafer arrays are sectioned to form the linear arrays of bonded components 136. The vertical chain dotted lines represent the dividing lines along which the linear arrays of bonded components may be sectioned subsequent to completing the linear processing steps such as nozzle forming, electrical connection and testing of the bonded component. The locations of the chain dotted lines in the wafers 110 are dimensionally determined by locations in the jigs (not shown) containing the three dowel pins.

The base wafer component is subjected to a series of processes performed on a wafer scale to form a rectangular array of base components 10. Typically, after poling, the base wafer is initially lapped to planarise and make parallel the faces of the wafer and a polymer film is applied to the wafer as disclosed in U.S. Pat. No. 5185055 (EP-B-0397441). Next a multiplicity of parallel grooves 120 are formed in the wafer—for example by sawing or dicing with a diamond/metal dicing blade—to provide grooves in the area of each base component 10 corresponding to those described by reference to FIG. 1 which provides ink channels 22 separated by opposing piezo-electric actuator walls 24.

Figure 6:
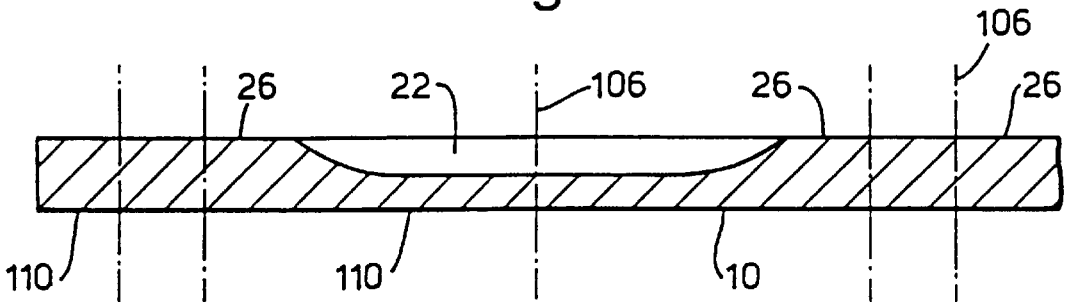
FIG. 6 is a vertical section through a base wafer.

As best seen in the section of FIG. 6, the base components are arranged in pairs symmetrically on either side of the horizontal dividing lines 106, so that the grooves in the forward part—which are comparatively deep to provide ink channels 22—are continuous between the pairs of components in horizontal linear arrays numbered 1&2, 3&4, 5&6, . . . 13&14. The grooves in the rearward part—which are comparatively shallow to provide the locations 26 for connection tracks 28—are continuous between the pairs of components in horizontal linear arrays numbered 2&3, 4&5, . . . 12&13. The vertical section profile of the grooves is shown in the wafer section in FIG. 6. Thus the closely spaced parallel grooves are continuous in the vertical direction in 14 strips divided by the vertical dividing lines 108 and extend substantially the full vertical dimension of the wafer. Each groove is formed in one pass varying the blade depth during its passage along the groove. In the periphery of the wafer is shown a kerf of wafer material which protects the inner working region from becoming chipped during wafer handling and does not form part of the array of base components 10. The wafer 110 is located by dowel pins in the sawing jig against edges 102 and 104.

As will become evident, it is desirable in certain of the subsequent processing steps—particularly those conducted on linear arrays—to provide assured registration with the grooves that are cut in the wafer scale processing. This can be achieved by the formation, simultaneously with the grooves, of a vertical datum edge, that is to say an edge extending parallel to the grooves. In this way it is arranged that when the wafer is subsequently divided into linear arrays, each array or strip retains a portion of the datum edge. For any one of the strips, therefore, registration with the datum edge will assure registration with every channel in that strip. The importance of this feature will become clearer as the linear processing steps are explained.

The datum edge may be formed as a cut through the entire wafer, for example removing the kerf at an edge remote from the locating pins. Alternatively, the edge may be formed as a recess serving as the weakening line for a subsequent breaking operation or as simply a datum formation. In a further alternative, a datum edge is formed, not simultaneously with the grooves, but in a subsequent operation which preserves the same location of the base wafer that was used for cutting the grooves. As will become apparent, this is the alternative employed in the presently described embodiment.

After forming grooves as described above and cleaning, electrode metal is deposited as described above by reference to FIG. 1 on a wafer scale, following which the polymer material on the tops of the walls is removed, and an electrical passivating layer is deposited over the wafer covering the tops of the walls and the sides and the base of the grooves providing an insulating coating to isolate the ink in the ink channels from the electrodes.

In the metal deposition step however a mask is placed along the horizontal dividing lines 106 which divide the grooved ends of component pairs (i.e. the horizontal lines between linear arrays 1&2, 3&4 . . . 13&14) so that the metal is deposited short of the ends of the channels after dividing into horizontal arrays. After passivation and cutting along the horizontal dividing lines the plating is then concealed so that is not exposed at the cuts ends of the channel walls.

In the passivation step a mask is similarly located along the alternate horizontal dividing lines 106 which divide the tracked ends of component pairs (i.e. the horizontal lines between linear arrays 1, 2&3, 4&5, . . . 12&13, 14) so that the connection tracks are not coated with passivation at their ends to enable a bonded wire connection to be made after cutting into horizontal linear arrays.

Figure 4:
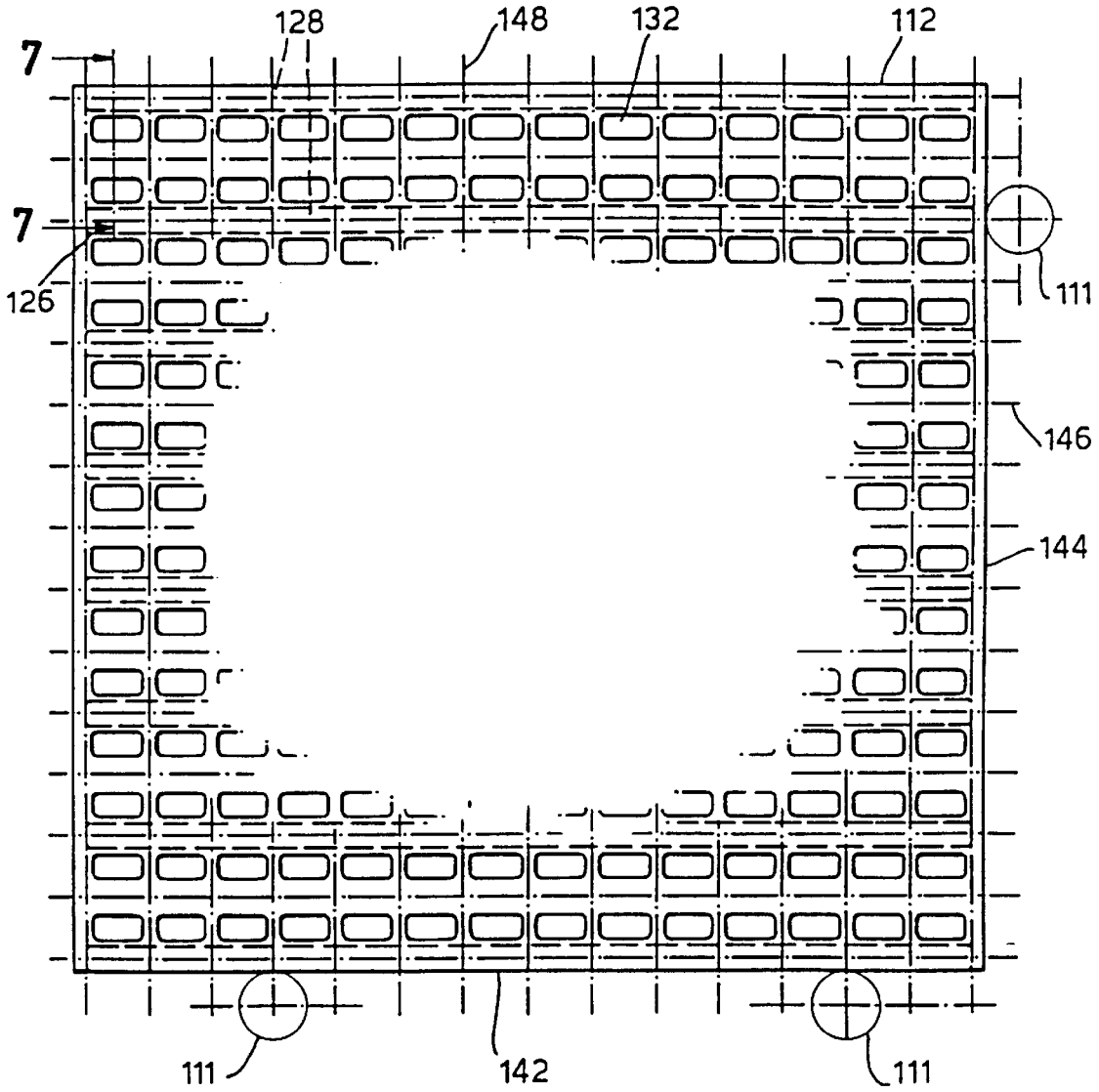
FIG. 4 shows a rectangular cover wafer comprising a rectangular array of printhead cover components in which windows for supply of ink and slots providing access for wire bonding to the connection tracks are formed.

A corresponding rectangular cover wafer 112 is shown in FIG. 4. This is similarly bounded round its periphery by straight line edges 142 and 144 used for locating the cover wafer against corresponding dowel pins in the dimensionally critical wafer process steps. For example when the wafer edges are pressed against dowel pins provided in a jig, notional horizontal and vertical dividing lines which are dimensionally determined in the jigs form an overlay which divides the wafer into a rectangular array of 14×14 regions each containing a cover component 12. The horizontal and vertical dividing lines are illustrated in FIG. 4 by horizontal and vertical chain dotted lines 146 and 148.

Figure 5:
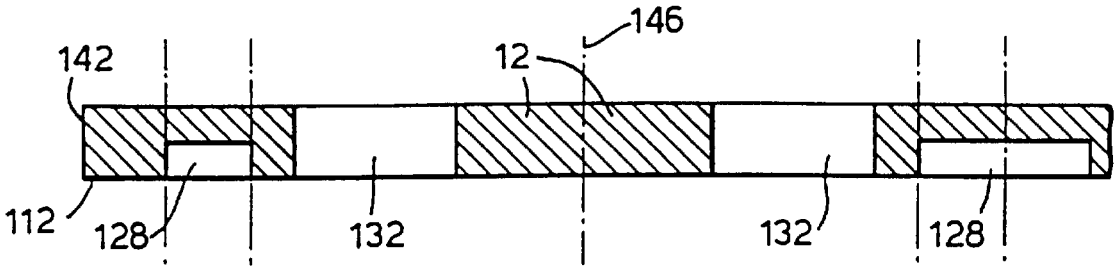
FIG. 5 is a vertical section through a cover wafer.

Typically the cover wafer 112 may be a PZT wafer of similar but thinner material than the base wafer 110; or may be a wafer of borosilicate glass, or a low thermal expansion glass-ceramic such as cordierite or alumina, or any other material whose thermal expansion coefficient closely matches that of the base component. Initially the cover wafer is lapped or otherwise planarised. The cover wafer is then cut using process equipment such as a laser cutter in which a laser beam is steered to correspond with the dimensions specified. This process is carried out in a jig by locating the wafer at its wafer edges 142 and 144 against dowel pins. Machining by milling may also be adopted, as may ultrasonic machining. This technique involves ultrasonic vibration of a hardened tool piece in an abrasive slurry of, for example, boron carbide. In the co-ordinates provided by the jig, the wafers are cut so as to form the windows 132 aligned in a vertical and horizontal array and the horizontal slots 128. The spacing and function of the windows 132 and the slots will be explained below. The vertical section of the cover is illustrated in FIG. 5.

After forming windows in the cover, the tops of the walls of the base component are coated with a bond material, and the cover component is aligned and brought into contact for bonding with the base component. The bonding process which is disclosed in co-pending international application PCT/GB94/01747 is also suitable for application at wafer scale.

Glue can be applied using an offset roller, with the rate of application being governed by the depth of dimples provided on the roller. There can be advantage in applying different depths of glue or different formulations of glue, in different locations across the wafer structure. For example, a relatively thin layer of epoxy material can be applied on the top of the actuator walls 20 and a relatively thick layer—typically of silica-loaded epoxy, applied on the shallow grooves 26 on which the tracks 28 are formed. It is convenient to employ different rollers, each corresponding to a particular glue formulation or glue depth. Each roller has dimpled regions corresponding with those areas on the wafers in which the roller is to be effective and is recessed in other regions. Glue can be applied to the base wafer alone, the cover wafer alone or to both the base and the cover wafer.

The thicker layer of glue placed in the shallow grooves which form the locations 26 for the tracks 28, serves to effect a seal. The silica-loaded enhances glue viscosity and thus reduces the tendency for glue to flow outwardly in a manner which would obstruct a subsequent wire bonding. If difficulties are nonetheless encountered, migration of glue along the track, beyond the confines of the cover wafer can be prevented by the application to the outer regions ofthe tracks, a blocking agent which has a low surface energy. Application of the blocking agent can similarly be conducted using a roller and removal of a suitable water-based blocking agent can be effected by immersion in de-ionised water.

During bonding both the base wafer 110 by edges 102 and 104 and the cover wafer 112 by edges 142 and 144 are aligned in the bonding jig against dowel pins. By this means the notional dividing lines 106 and 108 which divide separate base components in the base wafer are brought into alignment with the dividing lines 146 and 148 which divide separate cover components in the cover wafer. The bonding process involves pressing the components together by pressure, typically 5 MPa, to cause the bond material between the planarised faces of the wafers to flow and to allow the faces to be brought substantially into contact. The press is then heated allowing the bond material to flow again and to be cured to form a rectangular array of 14×14 bonded printhead components 136. In a modification, the press plates are heated before being brought into contact with the wafers. This avoids any risk of thermal expansion of the press plates, whilst in contact with the wafers, causing cracks or other damage. An alternative solution is to employ low thermal expansion press plates, such as made from borosilicate glass sheets.

To ensure that a uniform bond thickness is achieved over the entire wafer, it is desirable to provide one press plate which is rigid and another which has a degree of resilience. This can be achieved for example by the use of an elastomeric pad. The degree of resilient deformation necessary to ensure uniform bond thickness is typically in the region of 20 microns. It is found that an elastomeric pad having a dimpled structure is better than a flat pad, providing 20 micron deformation at 5 MPa.

The above process in which printhead components are bonded by applying a bond material, and pressing and heating the components in a wafer scale has the advantage that, as a larger number of parts are processed at one time, longer periods can be afforded to complete the bonding cycle than is available when bonding one component at a time. The longer cycle time makes it practical to use lower bond curing temperatures. This helps to both limit the peak temperature selected to initiate and execute a cure cycle and ensure that complete polymerisation of the glue has occurred. A lower bond curing temperature also reduces the problems of thermal expansion coefficient mismatch, thus increasing the range of materials that can be used for the cover.

With the wafer assembly remaining in contact with the dowel pins, the kerf from both the base and cover wafers is removed along the vertical edge remote from the dowel pins. This creates the previously mentioned datum edge or formation which extends parallel to—and in precise registration with—the grooves cut in the base wafer. If desired, the kerf can at this stage be removed from the horizontal edge remote from the dowel pins, forming a subsidiary, horizontal datum.

Figure 7:
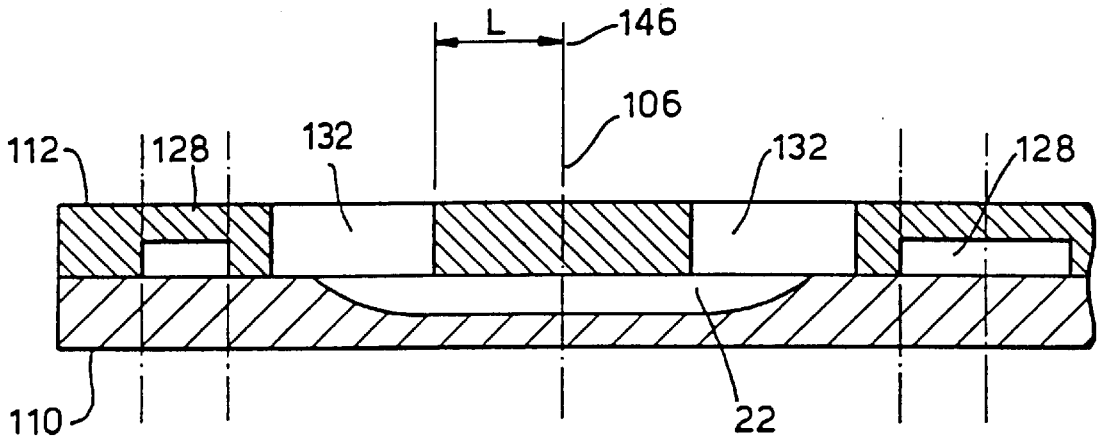
FIGS. 7 and 8 are vertical sections through a bonded wafer assembly at different process stages.
Figure 8:
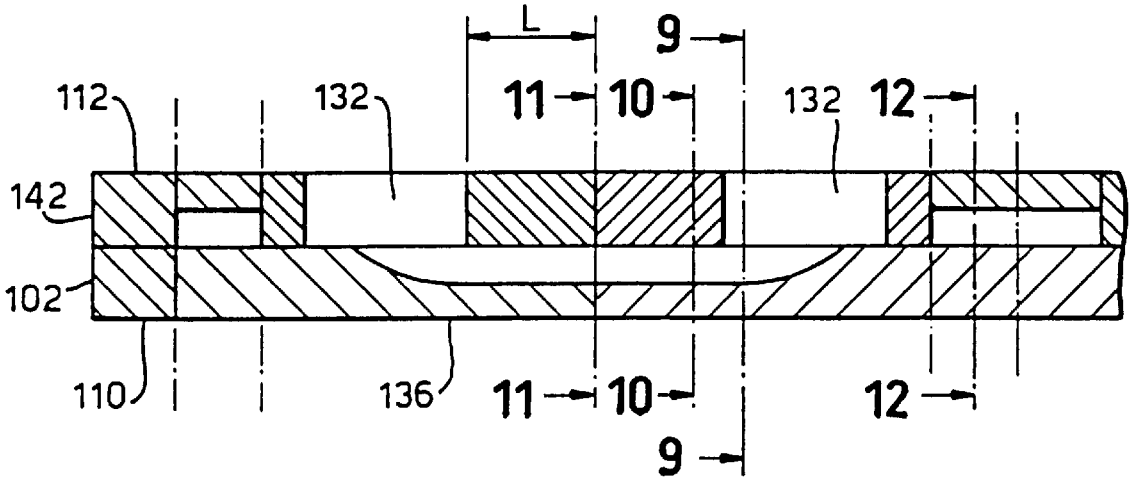

As shown in FIG. 7 the windows 132 now provide apertures for an ink supply manifold to supply ink to the channels 22 of each printhead component. There may, if necessary, be more than one window per printhead component. Also, the half depth windows defined by slots 128 in the cover, bridge the locations 26 for the connection tracks 28, where the electrodes 30 of the channels 22 in each printhead component are connected by wire bonding. These half depth windows are at a later stage sectioned as in FIG. 8 to expose the connection tracks prior to wire bonding. Between the windows 132 and the adjacent horizontal dividing lines, there is a length L of the cover component bonded to the walls which controls the active length of channels in the wafer component. The covers on the other side of the horizontal dividing line are located symmetrically, so that the distance separating pairs 1&2, 3&4, . . . 13&14 of the windows in the vertical direction is 2 L. The windows are dimensioned similarly to the manifold windows explained by reference to FIG. 2.

Figure 9:
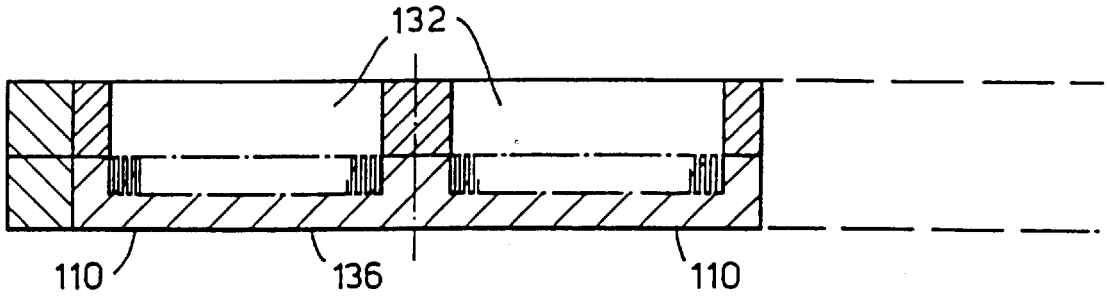
FIGS. 9 to 12 are longitudinal sections through a linear array of printhead components.
Figure 10:
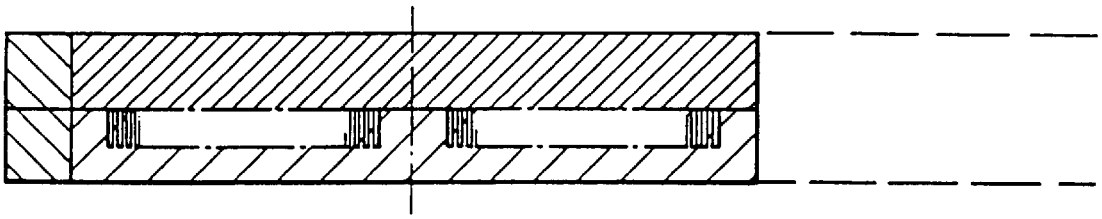
Figure 11:
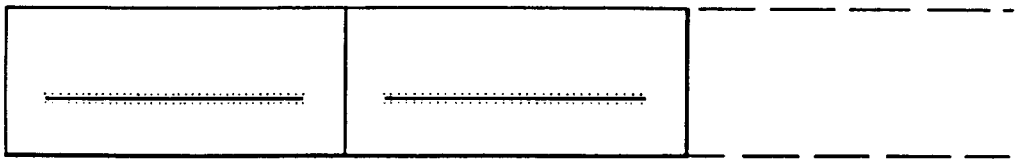
Figure 12:
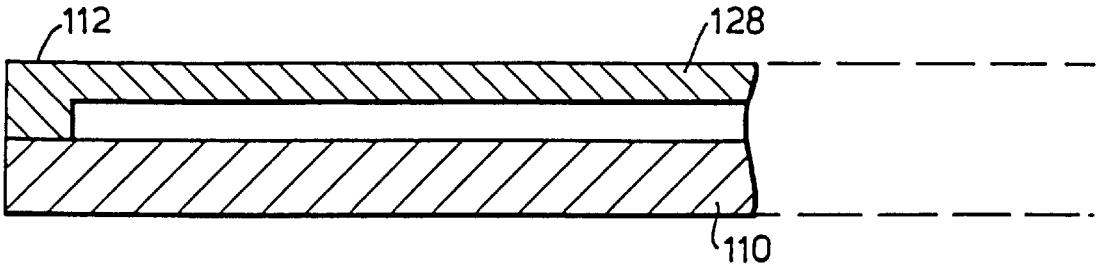

The array of bonded printhead components 136 is also illustrated in FIGS. 8 and 9 to 12. These show sections of the horizontal linear array of components 136 on section planes ZZ, TT, YY and SS illustrated in FIG. 8. FIG. 9 on Section ZZ is a section through the windows 132. FIG. 10 on Section TT illustrates the channel section. FIG. 11 on Section YY shows the view of the printhead components as seen on the nozzle plate bonded to the cut ends of the ink channels. FIG. 12 on Section SS is a section on the connection tracks 28 showing the base wafer 110 and the half depth window 128 in the cover.

After bonding, the rectangular array of bonded printhead components is sectioned along the horizontal dividing lines to form 14 linear arrays each comprising 14 bonded printhead components joined laterally at the vertical dividing lines, typically by means of a diamond impregnated dicing saw. One set of alternate section lines is cut through the slots 128, giving access on either side thereof to the connection tracks 28 for electrical connections. The other set of alternate section lines forms a section plane 34 through the open ends of the channels in the printhead components on either side thereof, the length of the channels being the distance L from the section plane to the windows 32. Advantageously the quality of the section plane at this end is suitably planarised for the application of a nozzle by bonding as indicated in co-pending international patent application PCT/GB94/01747. To reduce the effects on the planarity of this section plane of edge wear in the diamond impregnated dicing saw, it is preferably arranged that the saw projects a substantial distance through the bonded wafer.

The bonded wafer is located in the dicing jig during the wafer sectioning process by three dowels similarly located against the wafer edges to locate the horizontal dividing lines along which the bonded wafers are sectioned. In this way, registration is assured between the channels and the horizontal dividing lines. Alternatively, if preferred, registration can be achieved using the horizontal and vertical datum edges.

The fact that cuts are made transversely through the channel walls only after the bonding of the cover wafer, means that the likelihood of chipping or other damage to the wall surfaces, is much reduced.

Although the description provided above with particular reference to FIGS. 3 to 12 relates to a rectangular array of wafer, cover and bonded printhead components comprising a 14×14 array of parts, it will be realised that these numbers are for illustration only and a smaller or larger wafer may be employed. It will usually be preferable however for the vertical wafer dimension to be chosen so that an even number of linear arrays of components are adopted, so that opposed pairs of components are made in the vertical direction. There is also freedom to vary the component dimensions in the vertical direction according to product design. The dimensions are made greater in the vertical direction, in order to generate larger drops, or smaller, if the drops are smaller when operation occurs at a higher resonant frequency. When such changes are implemented there is greater or less number of components in line in the vertical direction in the wafer.

Also the components have been described as printheads of width typically one sixth to one tenth of an inch (4–2.5 mm) but printheads may be wider, if for example they are mounted at an angle, to increase the print density, or to print over a wider width. In the limit the component width is limited to one printhead component in the linear array, by the wafer width. However several components may be butted together and bonded to a common cover component to form an array of butted components wider than one wafer as disclosed in co-pending patent application WO/91/17051.

The step of sectioning the rectangular array of bonded printhead components is the final process step carried out on a rectangular array of bonded components. After forming linear arrays of n printhead components, a sequence of linear processing steps are performed. Whilst each linear array will probably require mounting in a suitable jig for these linear processing steps, there is of course an n-fold reduction in the number of jig loading and unloading operations. Importantly, the retention of a datum edge on each array which derives from the wafer-scale groove cutting operation, considerably simplifies registration. Thus each linear processing step which requires registration with the grooves and thus the ink channel locations, can simply be orientated with the datum edge at an end of the linear array.

One of the most critical process steps for the maintenance of print quality is nozzle formation. Nozzle formation is preferably performed by laser ablation as described for example in U.S. Pat. No. 5189437 (EP-B-0309146) after bonding of a nozzle plate to the printhead.

In accordance with a preferred feature of the present invention, an extended nozzle plate is bonded along the entire length of the linear array. The fact that the nozzle plate abuts a cut surface of the bonded base/cover wafer assembly, means that the necessary plane surface is achieved with minimal additional processing. With the nozzle plate bonded in position, preferably using the techniques disclosed in co-pending international patent application PCT/GB94/02341, nozzles are formed by laser ablation. Reference is directed in this regard to EP-A-0 309 146 and PCT/GB93/00250. Correct registration between the newly formed nozzles and the channels (which are not easily visible at this stage) is ensured by locating the strip of components in the laser ablation equipment, by reference to the datum edge at one end of the strip.

The size of the typical nozzle aperture is such that great care is necessary to exclude particulate matter from the ink channels. In the working printhead, this condition is maintained by a filter positioned over the ink manifold. It is also necessary, however, to ensure that no particulate residue from the manufacturing process remains in the ink channel after the nozzle plate and filter have been added. In an arrangement in accordance with the present invention, it becomes possible as essentially the first step in the linear processing, to add filters over the ink manifolds provided by the windows 132. Then, it is possible to flush all the channels forwardly through the filters and to secure the nozzle plate in position with the assurance that no particulate residue is trapped between the filter and the nozzle plate.

Following nozzle formation, electrical connections are made with the tracks 28 on the rearward section of the grooves in each component. Linear processing is again applied either as wire bonding or soldering, or by applying a chip to the tracks 18 in the form of a solder bump process. In an operation such as wire-bonding, there is a considerable efficiency arising from the assured accurate registration of all channels in the linear array, extending over many eventual printhead components. Once registration with the datum edge has been achieved, wire bonding over the entire array can proceed rapidly.

Following electrical connection, voltage signals may be applied to the printhead to test the integrity of the printhead.

There are a substantial number of tests that may be applied to test the integrity of the printhead either without or with ink (or an alternative test liquid) in the printhead. Included in the electrical tests without ink fluid are tests of the capacitance of the wall actuators, and the impedance or phase at the mechanical resonant frequencies of each wall actuator. As regards electrical tests with ink, the tests include conductance of the ink electrodes and passivation and acoustic resonances of the ink in the ink channels. Experience has shown that each test is capable of revealing the presence of one-or more specific form of fault arising in production. Electrical tests therefore provide valuable control of process parameters. Electrical testing is similarly a linear process step.

Testing in the linear array may take still other forms. Thus, where electrical termination includes connection to a drive circuit, testing can involve the actual ejection of ink or test liquid from the nozzles in "real" or simulated printing.

After completion of the linear processing steps, the linear arrays are sectioned with each array then providing n printhead components. The sectioning step is preferably in register with the datum edge so that parallelism between the channels and the relevant edges of the final component is assured. If an appropriately formed jig is employed for the linear array, it may be possible to section the array as an earlier step, with the jig maintaining the precise registration required for the subsequent linear processing steps. With the linear array being sectioned at locations in register with the datum formation—and thus in register with the channels—it is conveniently assured that each component has an external datum in register with the nozzles. This enables simple location of printhead components with respect to each other or with respect to a carrier or other component of the printer.

It will be recognised that whilst this description has concentrated on a specific construction and therefore on specific processing steps, the invention is broadly applicable to methods of making ink jet printhead components with a variety of different wafer processing steps and different linear array processing steps. Whilst the example has been taken of a single cover wafer being bonded to a single base wafer of substantially the same area, it may be convenient in certain applications to bond a number of base wafers to a single cover wafer. Also, but less likely to be useful, multiple cover wafers can be bonded to a single base wafer.

There will now be described an alternative printhead construction to which the teachings of the present invention are also applicable.

Figure 14:
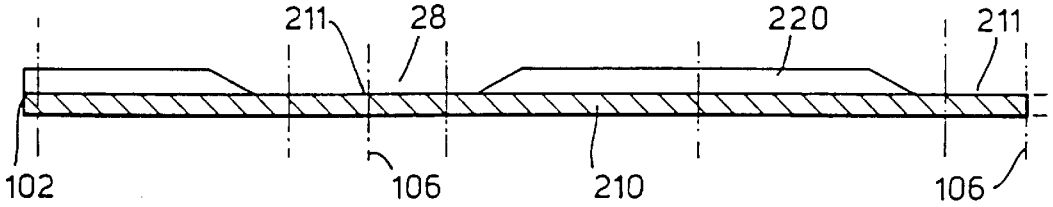
FIG. 14 is a vertical section, similar to FIG. 6, through an alternative base wafer for use with the cover wafer of FIG. 13.

FIG. 14 shows an alternative form of base wafer component 210 in section along a vertical dividing line 108 in the diagram corresponding to FIG. 6. In this form, after poling and lapping, the base wafer component 210 undergoes a number of process steps, the first being to cut trenches 211 horizontally across the width of the wafer in the regions corresponding to the rearward parts of the base components 10. Since the components are arranged on either side of horizontal dividing lines 106, the trenches are cut with a width to accommodate the supply manifold for the supply of liquid ink into two ink channels and the connection tracks of the back-to-back components. Between the trenches 211 there remains sufficient wafer material so that the grooves 220 in the forward parts can be formed to provide ink channels continuously between pairs of components placed front-to-front on either side of horizontal dividing lines 106 between the alternate component pairs.

After forming the trenches 211 in the base wafer component 210, a polymer film (as in U.S. Pat. No. 5185055 or EP-B-0397441) is applied to the base component and made to adhere in both the forward parts and the trenches 211 in the rearward parts. Grooves 220 are then formed in the wafer providing ink channels 22 in the forward part of each base component 10 separated by opposing piezo-electric actuator walls 24. The grooves also penetrate the film in the trenches 211 in the rearward part forming comparatively shallow grooves in the rearward part to provide connection tracks 28 aligned with the ink channels 22.

As with the previous embodiment, the grooves are continuous along the length of the wafer 210 in the vertical direction and are formed each in one pass of the cutter. It will be noted that this component design is reduced in length compared with the design illustrated in FIG. 6 because there is no run-out formed as a consequence of the cutter radius.

After forming the grooves as discussed above, and cleaning, electrode metal is deposited as described previously to form electrodes on the sides of the actuator walls 24 and connection tracks 28. The polymer film is then removed, thereby lifting electrode metal from the tops of the walls. The passivating layer is next deposited over the wafer covering the tops of the walls and the sides and the base of the grooves, thereby coating the electrodes to isolate the ink in the ink channels from the active electrode components. In these steps local masks are located in the regions of the horizontal dividing lines as previously indicated.

Figure 13:
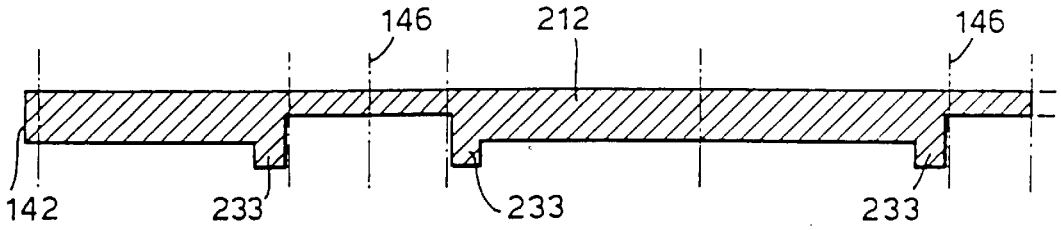
FIG. 13 is a vertical section, similar to FIG. 5, through an alternative cover wafer.

The corresponding cover wafer 212 is shown in FIG. 13 in section along a vertical dividing line 146. The cover wafer is selected from the materials previously indicated by reference to cover 112 and is machined by milling, to provide rear walls 233 of the ink manifolds in the form of a pair of walls in areas corresponding to each trench. These walls extend from the inner face of the cover by the same distance as the height of the actuator walls in the base wafer and extend the full length of the cover in the horizontal direction.

Figure 15:
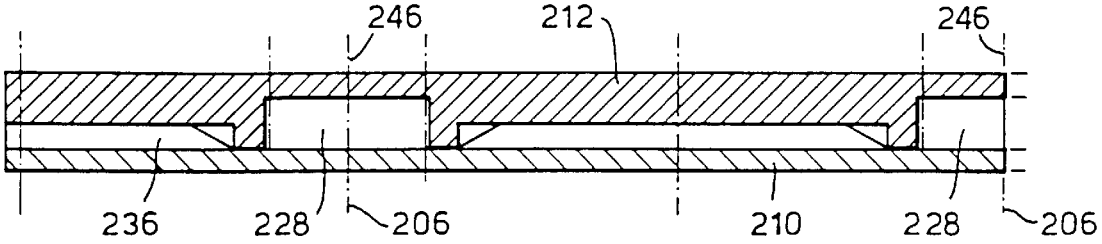
FIGS. 15 and 16 show the cover and base wafers of FIGS. 13 and 14 bonded together at respective, different process steps.
Figure 16:
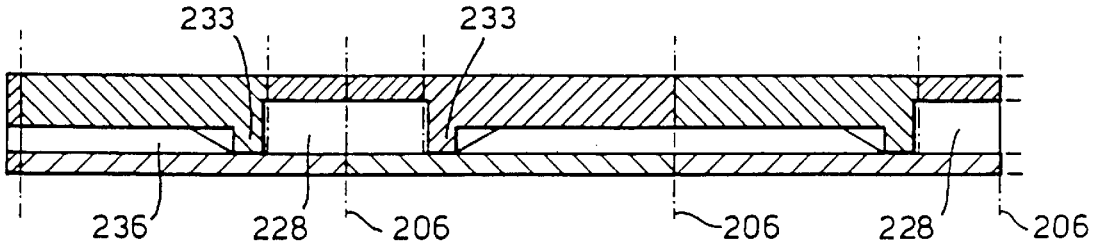

After forming the base wafer 210 and the cover wafer 212, there components are covered with a glue bond layer on the top of the actuator walls 24 and on the tops of the manifold rear walls 233 and then aligned, brought into contact and pressed together in a bonding jig, as previously described to form after curing an array of bonded printhead components 236. The bonded component is illustrated in FIG. 15.

After bonding, the array 236 is sectioned along the horizontal dividing line 206, 246 to form linear arrays of printhead components. During sectioning the cover is also cut in the region of slots 228 between the rear walls 233 of the manifold for access to the connection tracks. In this design, access for ink may be provided not as in the array of linear components 136 through windows 132 formed in the cover, but by supplying ink from the ends of each manifold between the actuator walls and the rear walls of the manifold. However, it will be apparent that windows may also be cut in the cover part to increase access for ink when required.

Whilst the structure described with reference to FIGS. 13 to 16 can with advantage be manufactured using a method as previously described, it can also be made in other ways. Indeed, the advantages which this structure offers, principally in reducing the length dimension in the piezoelectric material, are not dependent upon the manner in which the process steps are arranged. The saving in piezoelectric material can be expected to become more important in relative terms as the active length of the channels decreases. Thus, the use of a trench, perpendicular to the channels, to provide an ink conduit will be of considerable benefit in printhead designs operating at high frequencies with short channels.

It should be understood that this invention has been described by way of examples only and a wide variety of modifications can be made without departing from the scope of the invention.

The benefits of a datum formation created in the same operation as the grooves (or in a separate operation preserving the same location of the base wafer) have already been explained. A single datum formation can, after sectioning into linear arrays provide one segment of the datum formation in each array. This segment will provide for accurate registering during the linear processing such as nozzle formation. If desired, a plurality of datum formations can be provided; in one example, a sufficient number are provided to give each printhead component a precise datum. In this way, a positive chain of registration can be achieved from the base wafer to the individual printhead component.

We claim:

1. A method of making pulsed droplet deposition heads each having a predetermined number of droplet liquid channels comprising the steps of surface area processing on a wafer scale to form a rectangular array of bonded head components, sectioning said rectangular array to form strips each comprising two or more bonded head components in a linear array; and linear processing of a plurality of said linear arrays of bonded head components including forming a nozzle for each channel.

2. A method according to claim 1, wherein the step of linear processing further includes connecting electrical terminations with the channels.

3. A method according to claim 1, wherein the step of forming nozzles comprises bonding to each strip a nozzle plate for defining a nozzle for each channel of the strip.

4. A method according to claim 1, wherein the step of surface processing comprises the steps of locating a base wafer; forming grooves in the base wafer and bonding a cover wafer to the base wafer so as to close a portion at least of each groove, thereby to form droplet deposition channels.

5. A method according to claim 4, wherein the step of locating a base wafer utilises edge registration.

6. A method according to claim 1, wherein the step of sectioning said rectangular array to form strips comprises sectioning said rectangular array orthogonally of the channels.

7. A method of making ink jet printhead components, each having N parallel ink channels of length L terminating in respective nozzles, comprising the steps of providing a base wafer; processing the base wafer to define n×N parallel groove formations of a length in excess of m×L, where m and n are integers greater than one; providing a cover over said base wafer in an integral wafer assembly, with the cover serving to close portions of said groove formations to form channels; sectioning said wafer assembly along parallel first section lines perpendicular to said groove formations to form m strips each sectionable along second section lines parallel to said groove formations to form n printhead components; and applying to each of the said strips, at the location of a first section line, a nozzle plate to define said nozzles.

8. A method according to claim 7, wherein a common cover is bonded to a plurality of like base wafers in an integral wafer assembly.

9. A method according to claim 7, wherein with the same location of the base wafer as used in the forming of said grooves, further comprising the step of forming at least one datum formation defining a datum line, wherein said sectioning comprises forming strips perpendicular to the datum line with each strip containing a segment of said data formation providing registration with said channels.

10. A method according to claim 9, wherein there is provided a single datum formation providing a common datum line on a wafer scale.

11. A method according to claim 9, wherein there is provided a plurality of datum formations providing respective parallel datum lines each extending across said strips.

12. A method according to claim 9, wherein said datum formation comprises a cut edge parallel to said grooves.

13. A method according to claim 9, wherein said datum formation comprises a slot parallel to said grooves forming a weakening line for a subsequent breaking operation.

14. A method according to claim 9, wherein each linear array is divided into components at locations in register with said datum formation.

15. A method according to claim 9, wherein the groove formations and the datum formation are formed in a single operation.

16. A method according to claim 7, wherein said groove formations are formed by the removal of material.

17. A method according to claim 7, wherein each groove formation varies periodically in depth along its length.

18. A method according to claim 17, wherein the period of said depth variation is period is 2/m.

19. A method according to claim 7, wherein the step of processing the base wafer to define groove formations comprises forming grooves in the wafer symmetrically on either side of horizontal dividing lines to form opposed pairs of base components.

20. A method according to claim 7, wherein said base wafer comprises piezoelectric material.

21. A method according to claim 20, wherein the step of processing the base wafer comprises providing electrodes for application of fields to walls defined between adjacent groove formations.

22. A method according to claim 21, wherein said electrodes are provided in a deposition process.

23. A method according to claim 21, wherein said step of linear processing further comprises the step of connecting drive means to said electrodes and applying electrical signals thereby to test selected ones of said channels.

24. A method according to claim 20, wherein said walls are movable in shear mode.

25. A method according to claim 7, wherein the cover is adhesively bonded to the base wafer to form said integral wafer assembly.

26. A method according to claim 25, wherein adhesive is applied to either or both opposing surfaces of the cover and base wafer in a manner which varies across the wafer assembly.

27. A method according to claim 25, wherein the depth of the applied adhesive varies across the wafer assembly.

28. A method according to claim 25, wherein the formulation of the adhesive varies across the wafer assembly.

29. A method according to claim 25, wherein a blocking material is applied to the base wafer to limit spread of the adhesive.

30. A method according to claim 7, comprising the step of bonding base and cover wafers using heat and pressure.

31. A method according to claim 7, wherein surface formations are formed in the cover prior to assembly of the wafer assembly.

32. A method according to claim 31, wherein said surface formations comprise for each bonded head or printhead component at least one window serving as an ink supply manifold for the channels of that component.

33. A method according to claim 31, wherein said surface formations comprise undercut regions facing said base wafer.

34. A method according to claim 33, wherein said undercut regions are removed after assembly of the cover with said base wafer to provide access to the base wafer.

35. A method according to claim 7, wherein the step of sectioning said wafer assembly along parallel first section lines provides a flat plane for nozzle plate bonding.

36. A method according to claim 7, wherein nozzles are formed in the nozzle plate after bonding of the nozzle plate.

37. A method according to claim 7, wherein electrical connections are made with the channels of each strip prior to sectioning of the strip into printhead components.

38. A method according to claim 7, wherein each strip is sectioned into components at locations in register with said datum formation to provide on each component at least one external surface datum which is in precise alignment with the channels of that component.

39. A method according to claim 7, wherein each of said strips undergoes a test procedure prior to sectioning of the strip into printhead components.

40. A method according to claim 39, wherein said test procedure includes establishing probe contact with the strip.

41. A method according to claim 40, wherein said probe contact is established at locations in register with said datum formation.

42. A method according to claim 39, wherein said test procedure comprises measuring a resonant characteristic of the strips.

43. A method according to claim 42, wherein said test procedure comprises measuring a resonant frequency of walls defined between adjacent groove formations.

44. A method according to claim 42, wherein said test procedure comprises comparing different resonant frequencies of walls defined between adjacent groove formations.

45. A method according to claim 44, wherein said test procedure comprises comparing the resonant frequency of said walls between different channels.

46. A method according to claim 44, wherein said test procedure comprises comparing the resonant frequency of said walls at different locations along the length of the channels.

47. A method according to claim 7, wherein the step of processing the base wafer further comprises the formation of a trench extending perpendicularly of the groove formations, said trench serving in the printhead component for the supply of ink to the channels of the printhead.

48. A method of making ink jet printhead components, each having N parallel ink channels of length L terminating in respective nozzles, comprising the steps of providing a base wafer; processing the base wafer to define n×N parallel groove formations of a length in excess of m×L, where n is an integer and m is an integer greater than 4, the section of each groove formation varying along the length thereof with alternating mirror reversed groove segments; providing a cover over said base wafer in an integral wafer assembly, with the cover serving to close portions of said groove formations to form channels separated by channel walls; sectioning said wafer assembly along parallel first section lines perpendicular to said groove formations to form m strips, the first section lines alternating odd and even with said groove segments; applying to each of the said strips, at the location of a first odd section line, a nozzle plate to define said nozzles; and, where n is greater than 1, sectioning each strip along second section lines parallel to said groove formations to form n printhead components.

49. A method according to claim 48, wherein an end of each strip is defined by an odd said first section line.

50. A method according to claim 48, wherein an end of each strip is defined by an even said first section line.

51. A method according to claim 50, wherein the cover in a direction parallel to the groove formations has alternating mirror reversed cover length segments in register with said groove segments.

52. A method according to claim 51, wherein each groove segment has adjacent the even first section lines a region of reduced wall height and wherein each cover length segment has adjacent the even first section lines a region which is removed after assembly of the integral wafer assembly.

53. A method according to claim 52, wherein each said region of the cover is undercut to facilitate removal without damage to the base wafer.

54. A method according to claim 50, wherein each groove segment has adjacent the even first section lines a region of reduced wall height and wherein each cover length segment has adjacent the even first section lines a projection extending into the region of reduced wall height to close the channels.

55. A method according to claim 48, wherein each groove segment has adjacent the even first section lines a region of reduced wall height.

56. A method according to claim 55, wherein the region of reduced wall height accommodates electrical terminations for the respective channels.

57. A method according to claim 55, wherein the region of reduced wall height serves for the supply of ink to the respective channels from a common source of ink.

58. A method according to claim 55, wherein the region of reduced wall height is formed by reducing locally the depth of the groove formation.

59. A method according to claim 55, wherein the region of reduced wall height is formed by a trench extending perpendicularly of the groove formations.

60. A method according to claim 59, wherein the trench has inclined edges.

* * * * *